US005324897A

United States Patent [19]

Melgoza et al.

[11] Patent Number: 5,324,897

[45] Date of Patent: Jun. 28, 1994

[54] SWITCH LOCKING DEVICE

[75] Inventors: Aaron D. Melgoza, Oakley, Calif.; Ernest G. Hoffman, Middlefield; John L. Sandor, Wallingford, both of Conn.

[73] Assignee: Hubbell Incorporated, Orange, Conn.

[21] Appl. No.: 67,932

[22] Filed: May 27, 1993

[51] Int. Cl.[5] ..... H01H 9/20

[52] U.S. Cl. ..... 200/43.11; 200/43.14; 200/43.15; 200/43.16; 200/43.19; 70/DIG. 30

[58] Field of Search ..... 200/43.16, 43.18, 43.19, 200/43.21, 43.22, 43.11, 43.14, 43.15; 70/DIG. 30

[56] References Cited

U.S. PATENT DOCUMENTS

| | | | |
|---|---|---|---|
| 2,832,857 | 4/1958 | Landmeier | 200/43.19 |
| 2,946,864 | 7/1960 | Marien | 200/43.14 X |
| 3,024,337 | 3/1962 | Goudy et al. | 200/43.22 X |
| 3,170,050 | 2/1965 | Buturuga | 200/43.19 |
| 4,102,471 | 7/1978 | Lore et al. | 200/43.16 X |
| 4,467,152 | 8/1984 | Gordy | 200/43.19 |
| 4,468,544 | 8/1984 | Wainess | 200/43.16 |
| 4,506,120 | 3/1985 | Fleischman | 200/42 |
| 4,733,029 | 3/1988 | Kobayashi | 200/43.19 |
| 4,876,425 | 10/1989 | Woskow | 200/43.16 |
| 4,882,456 | 11/1989 | Hovanic | 200/43.19 |
| 5,148,910 | 9/1992 | Williams | 200/43.19 |
| 5,260,528 | 11/1993 | Benda | 200/43.14 |

FOREIGN PATENT DOCUMENTS

| | | | |
|---|---|---|---|
| 676985 | 6/1939 | Fed. Rep. of Germany | 200/43.16 |
| 2226911 | 11/1974 | France | 200/43.22 |
| 208197 | 11/1959 | Netherlands | 200/43.16 |
| 2208454 | 3/1989 | United Kingdom | 200/43.19 |

*Primary Examiner*—Ernest G. Cusick

*Attorney, Agent, or Firm*—Jerry M. Presson; Mark S. Bicks

[57] ABSTRACT

A locking device for an electrical toggle switch has a fixed, one piece locking body. An opening extends through the body for receiving a mounting screw for a switch face plate to mount the body on the face plate. The mounting screw receiving opening is provided with an access in the body adjacent the opening to locate the mounting screw in the opening while the mounting screw is still engaged with the switch face plate. An additional opening extends through the body and is spaced from the mounting screw receiving opening. The additional opening is defined by an abutment for engaging the toggle arm of the switch and for preventing movement of the toggle arm from one position to another position, particularly from an off position to an on position.

27 Claims, 3 Drawing Sheets

FIG. 4
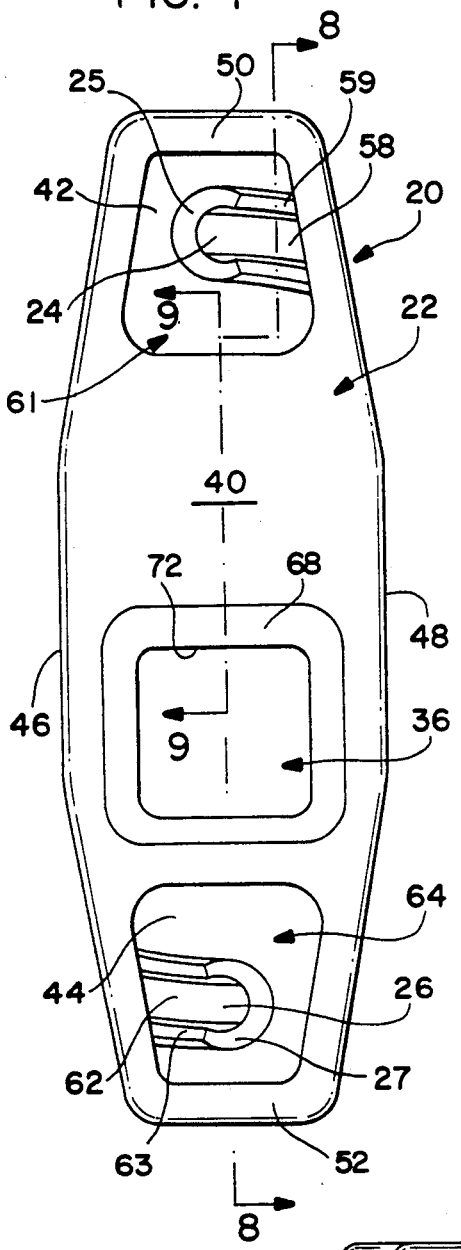
FIG. 6
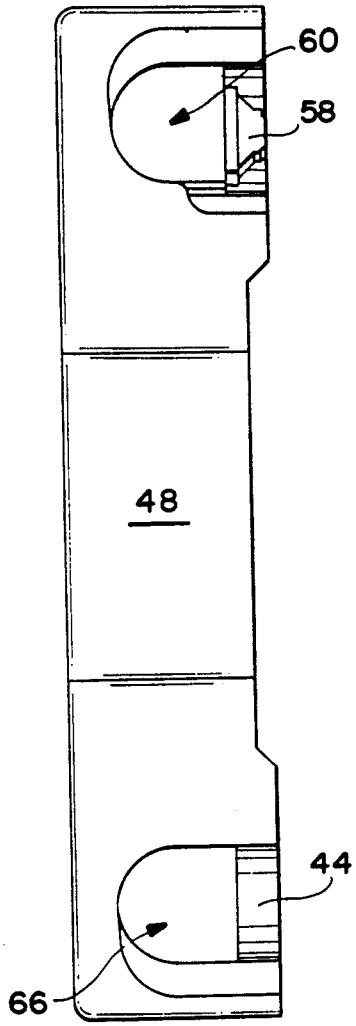
FIG. 10
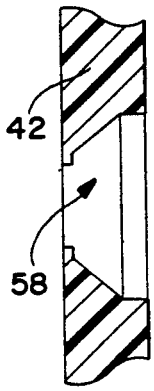
FIG. 11
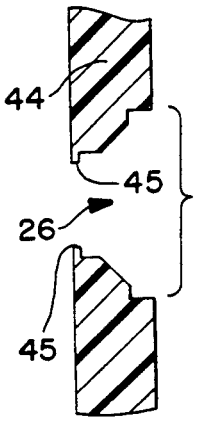
FIG. 9
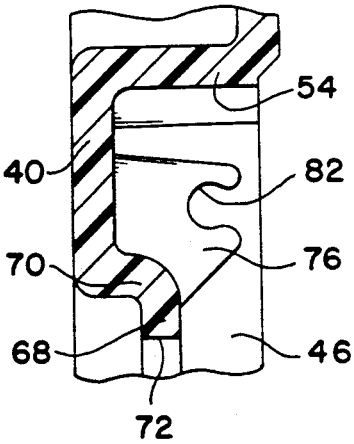
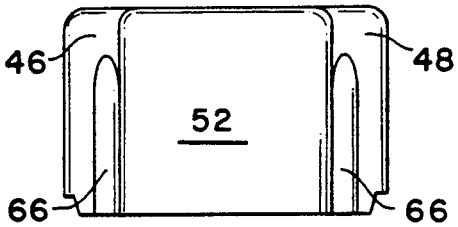
FIG. 5

FIG. 7
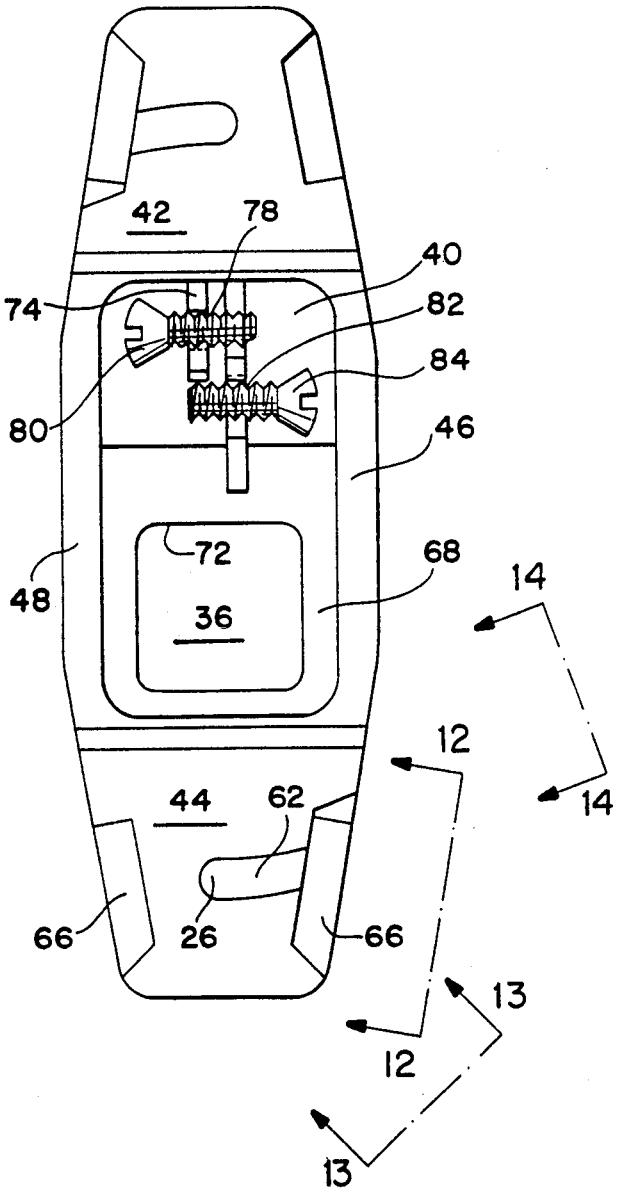
FIG. 8
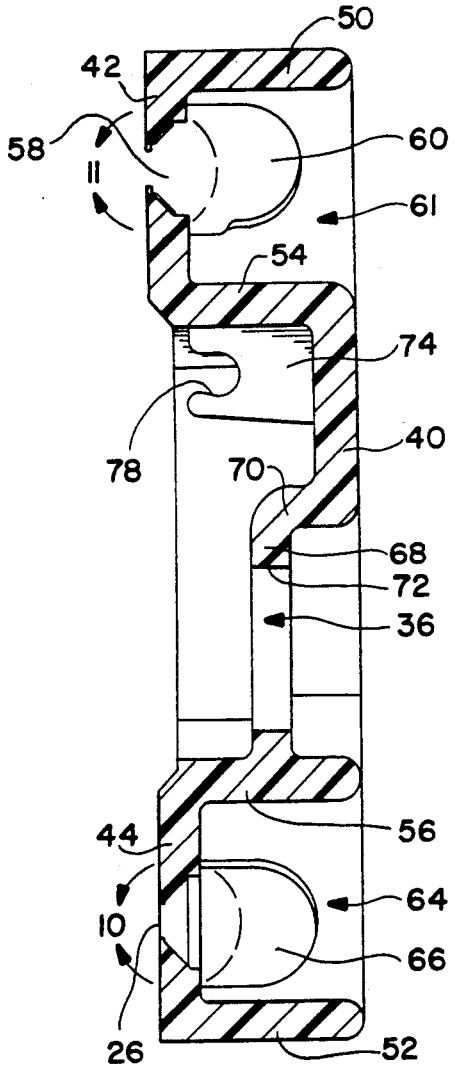
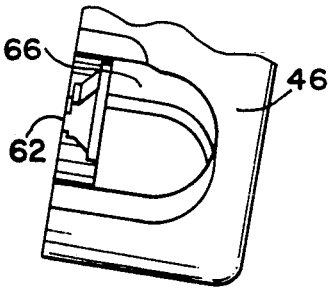
FIG. 12
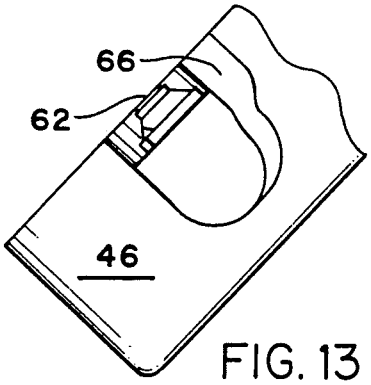
FIG. 13
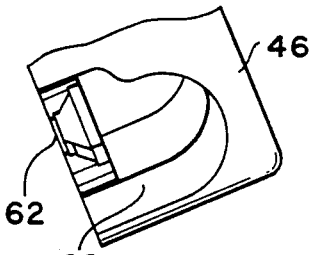
FIG. 14

SWITCH LOCKING DEVICE

FIELD OF THE INVENTION

The present invention relates to a locking device to retain the toggle switch in an off position and to prevent inadvertent movement of the switch to an on position The locking device is secured to the switch with the face plate mounting screws, and has an opening defined by an abutment engaging and holding the switch toggle arm in its off position.

BACKGROUND OF THE INVENTION

Electrical circuits in residential and commercial buildings are often controlled by toggle switches. These toggle switches comprise an arm which is pivoted normally between an on position (upward) and an off position (downward). This switch may be located close to the load controlled by the switch, or may be significantly remotely located from such load.

When an electrician or other worker performing operations on the load or on the load side of the electric circuit therefor, safety requires that the switch controlling that circuit be in an off position and maintained in its off position. Although the circuit breaker for that circuit may be deactivated to provide greater safety, deactivating the circuit breaker would disrupt significantly more circuits than would be necessary, needlessly disrupting use of other load devices.

Inadvertent actuation of the switch to its on position while work is being performed on the load side of the circuit can cause injury to the worker and damage to the circuit and load equipment. Thus, the switch needs to be securely maintained in its off position while the work is being performed.

A number of different safety devices have been provided for both toggle electrical switches and for circuit breakers having a toggle switch mechanism. Typical examples are disclosed in U.S. Pat. No. 3,170,050 to Buturuga, U.S. Pat. No. 4,468,544 to Wainess, U.S. Pat. No. 4,876,425 to Woskow, U.S. Pat. No. 4,467,152 to Gordy, U.S. Pat. No. 4,506,120 to Fleischman, U.S. Pat. No. 4,733,029 to Kobayashi, U.S. Pat. No. 4,882,426 to Hovanic and U.S. Pat. No. 5,148,910 to Williams. However, these devices are not simple to make and use, and do not provide an adequately secure mechanism for preventing inadvertent actuation of the switch. For example, many of these devices are made up of multiple pieces or parts which increase the difficulty for manufacture. Many of the devices can be switched to the off position by manually manipulating device the guard, without removing the guard device from the face plate. These devices also require complete removable of the face plate mounting screws to mount the safety device on the face plate, complicating installation and increasing the likelihood of losing the face plate mounting screws, and thereby discouraging its use.

SUMMARY OF THE INVENTION

An object of the present invention is to provide a switch locking device for an electrical toggle switch which is simple and inexpensive to manufacture and use.

Another object of the present invention is to provide a switch locking device for an electrical toggle switch which can be installed with the face plate mounting screws, without total removal of the screws from the switch face plate.

A further object of the present invention is to provide a switch locking device for an electrical toggle switch which has a one piece, unitary construction.

Yet another object of the present invention is to provide a switch locking device for an electrical toggle switch adapted for receiving a hanging padlock for preventing inadvertent removal of the device from the switch face plate.

A yet further object of the present invention is to provide a switch locking device for an electrical toggle switch adapted for receiving a warning tag for advising others of potential injury or damage.

The foregoing objects are basically obtained by a locking device for an electrical toggle switch, comprising a fixed, one piece body with first and second openings, and access means. The first opening extends through the body for receiving a first mounting screw for a switch face plate to mount the body on the face plate. The second opening extends through the body, is spaced from the first opening, and is defined by abutment means for engaging a toggle arm of a switch and for preventing movement of the toggle arm from a first position to a second position. The first access means is adjacent the first opening, and locates the mounting screw in the first opening while the screw is still engaged with the switch face plate.

By forming the locking device in this manner, the device can simply formed or molded as a one piece body. The access means simplifies installation of the locking device onto the switch face plate merely by loosening at least one of the screws, placing the device against the switch plate with the screw extending through the access means, moving the locking device to its proper position, and then retightening the switch face plate screw. The installation is particularly facilitated by being able to mount the locking device while the loosened screws are still at least partially retained in the face plate. By not completely removing the screws, the chance of the screws becoming lost or misplaced is significantly reduced. Installation time is also reduced. The one piece structure, in being fixed, prevents inadvertent actuation of the switch since the entire device must be removed from the face plate before the switch can be moved. The switch can be locked in the off position or in the on position, depending on the orientation of the locking device on the face plate.

Other objects, advantages, and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 4 is an enlarged, front elevational view of the switch locking device according to the first embodiment.

FIG. 5 bottom plan view of the switch locking device of FIG. 4;

FIG. 6 is a side elevational view of the switch locking device of FIG. 4;

FIG. 7 is a rear elevational view of the switch locking device of FIG. 4;

FIG. 8 is a side elevational view in section taken along lines 8—8 of FIG. 4;

FIG. 9 is a partial, side elevational view, in section taken along lines 9—9 of FIG. 4;

FIG. 10 is an enlarged view of the indicated portion of FIG. 8;

FIG. 11 is an enlarged view of the indicated portion of FIG. 8;

FIG. 12-14 are angular, side elevational views taken along lines 12—12, 13—13 and 14—14, respectively, of FIG. 7;

DETAILED DESCRIPTION OF THE INVENTION

Figure 1:
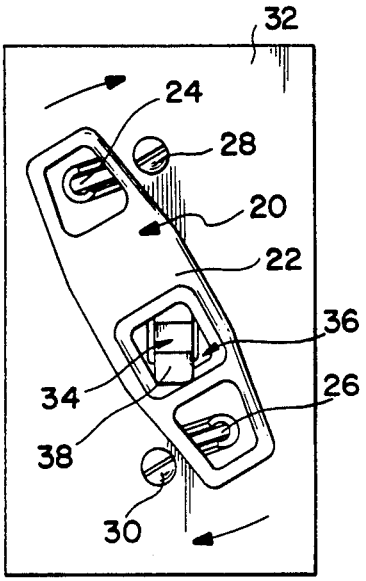
FIG. 1 is a front elevational view of a switch locking device according the first embodiment of the present invention, in the process of being installed on a switch face plate.
Figure 2:
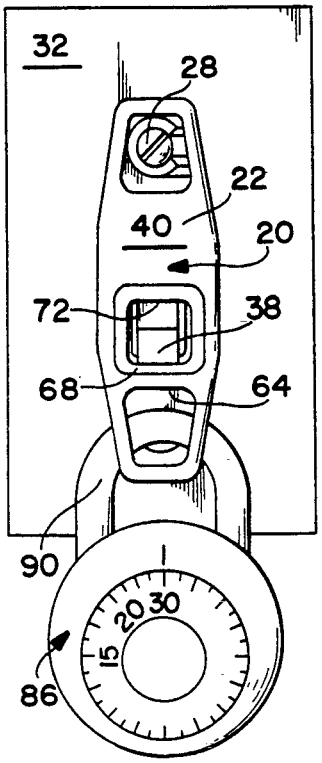
FIG. 2 is a front elevational view of the switch locking device of FIG. 1 in its fully installed position with a padlock hanging therefrom.
Figure 3:
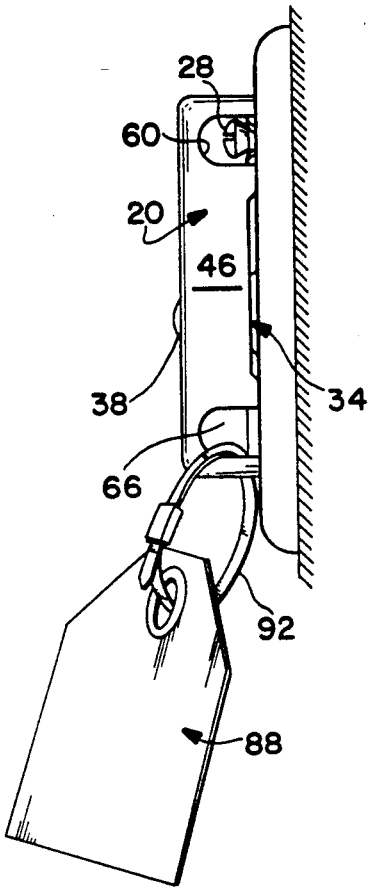
FIG. 3 is a side elevational view of the switch locking device of FIG. 2, but with the padlock replaced by a hanging tag.

Referring initially to FIGS. 1-3, the switch locking device 20 according to the first embodiment of the present invention comprises a one piece, unitary body 22 of relatively rigid material Body 22 has openings 24 and 26 adjacent its opposite longitudinal ends for receiving face plate mounting screws 28 and 30. Mounting screws 28 and 30 secure face plate 32 to a conventional switch body 34. Between openings 24 and 26, body 22 has a central opening 36. Toggle arm 38 of switch body 34 extends through central opening 36 and is engaged by an edge of central opening 36 to retain toggle arm 38 in the off position illustrated in FIGS. 1-3. If the locking device is inverted from the position shown in FIGS. 2 and 3, the edge of central opening 36 will engage and retain toggle arm 38 in the on position.

Referring to FIGS. 4-14, body 22 comprises an upper base 40 and lower bases 42 and 44. Bases 42 and 44 are co-planar, and are spaced from and parallel to the plane of base 40. The bases are connected by side walls 46 and 48, the end walls 50 and 52 and intermediate walls 54 and 56.

Opening 24 is formed in lower base 42. An arcuate access slot 58 extends entirely through base 42 and extends laterally from opening 24 through side wall 48. The base portions 25 surrounding opening 24 and the base portions 58 surrounding slot 58 are countersunk to mate with the frustoconical portion on the head a standard face plate mounting screw. End wall 50, intermediate wall 56 and side walls 46 and 48 define a tool passageway 61 above base 42 and coaxially aligned with opening 24 to allow a screw driver to engage a mounting screw received in opening 24. The side walls 46 and 48 have apertures 60 laterally adjacent to opening 24. Apertures 60 are axially aligned to define a transverse bore through body 22 which opens on opposite sides of the body and extends across and over opening 24 and through tool passageway 61. Slot 58 opens directly into opening 60 in side wall 48.

The structure surrounding opening 26 is similar to that surrounding opening 24. Opening 26 extends through lower base 44. An arcuate access slot 62 extends through base 44 and laterally from opening 26, opening on side wall 46. End wall 52, intermediate wall 56, and side walls 46 and 48 define a tool passageway 64 to permit access with a screwdriver to a mounting screw located within opening 26 for loosening and tightening such mounting screw. Apertures 66 are formed in side walls 46 and 48 adjacent opening 26 to define a transverse bore through the side walls and tool passageway 64, and over opening 26. Slot 62 opens into aperture 66 in side wall 46. Base portions 63 about slot 62 and base portions 27 about opening 26 are countersunk to accommodate the frustoconical portion of the head of the standard face plate mounting screw.

The countersinking of the edges defining slots 62 and 58 is best illustrated in FIG. 10, while the countersinking for the openings 24 and 26 is best illustrated in FIG. 11. As illustrated in FIG. 11, base 44 has riblets 45 which extend radially inwardly toward the center of the mounting screw receiving openings. These riblets are flexible and can frictionally retain mounting screws in the openings to facilitate mounting the locking device when the mounting screws had been completely removed from the face plate.

The arcs defined by slots 58 and 62 lie on diametrically opposed portions of the same circle. The arcuate slots enable the device to be rotated into position as graphically depicted in FIG. 1.

Central opening 36 is defined in body 22 by a flange 68 extending around the periphery of opening 36. Flange 68 extends inwardly from side walls 46 and 48, intermediate wall 56 and a wall 70 depending from upper base 40. In this matter, peripheral flange 68 is located in a plane parallel to and between the planes of the lower bases 42 and 44 and the upper base 40. The abutment 72 for engaging the switch toggle arm and maintaining it in its off position, defined by a portion of flange 68, is spaced above or from the face plate to accommodate the rounded portion connecting the toggle arm to the remainder of the switch body 34.

As best illustrated in FIGS. 7-9, the rear surface of upper base 40 has two rearwardly extending flanges 74 and 76. Flange 74 has a notch 78 for removably receiving a mounting screw 80. Flange 76 has a notch 82 for removably receiving a screw 84. The notches provide a storage location for positively retaining spare mounting screws. In this manner, flanges 74 and 76 provide first and second retention means.

The locking device 20 can be suitably formed as one piece of molded plastic. The device should be rigid to maintain its shape and to prevent deflection.

To mount locking device 20 on face plate 32, screws 28 and 30 are initially loosen to space the heads of the mounting screws from face place 32. The heads of the screws are spaced a sufficient distance, (corresponding to the thickness of bases 42 and 44) from the exposed surface of the face plate to allow the threaded portions the screws to easily enter slots 58 and 62. The locking device is then placed on the surface of the face plate as illustrated in FIG. 1, with toggle arm 38 extending through central opening 36 and the device angularly oriented, with the open end of slot 58 facing screw 28 and the open end of slot 62 facing mounting screw 30. The device is then rotated such that the screws enter slots 58 and 26 and are received and stopped within openings 24 and 26. A screwdriver can then be inserted into the tool passageways 61 and 64 to tighten the heads of the screws against lower bases 42 and 44 to secure the device on the face plate. In this position, abutment 72 engages a portion of toggle arm 38 to retain the toggle arm in its down or off position as illustrated in FIGS. 2 and 3, due to the relative spacing of openings 24 and 26 from abutment 72.

To avoid inadvertent removal of the locking device from the face plate, a padlock 86 can be attached to the locking device. Lock 86 is secured to the locking device, as illustrated in FIG. 2, by passing the hasp 90 thereof through the aligned apertures 66. Locating hasp 90 in the apertures allows the lock to hang from the locking device and the hasp to block access to mounting screw 30 through tool passageway 64. Until the lock is removed, the device cannot be removed and the switch cannot be moved to its on position.

Alternatively, a hang tag 88 can be attached by an openable loop 92 to the locking device. Loop 92 similarly passes through apertures 66, as illustrated in FIG. 3. Tag 88 advises others that operating the switch might cause injury or damage.

The device is removed from the switch device by first removing padlock 86 or hang tag 88. The screws are then loosen to permit the locking device to be rotated to the position illustrated in FIG. 1 and then lifted from the face plate and switch body device. The screws can then be retightened so that the switch will again be ready for use.

By operating the device in this manner, the screws are never completely removed from the face plate, but always remain at least partially engaged therewith. This saves time during installation and removal, and significantly reduces the possibility of losing the mounting screws.

Figure 15:
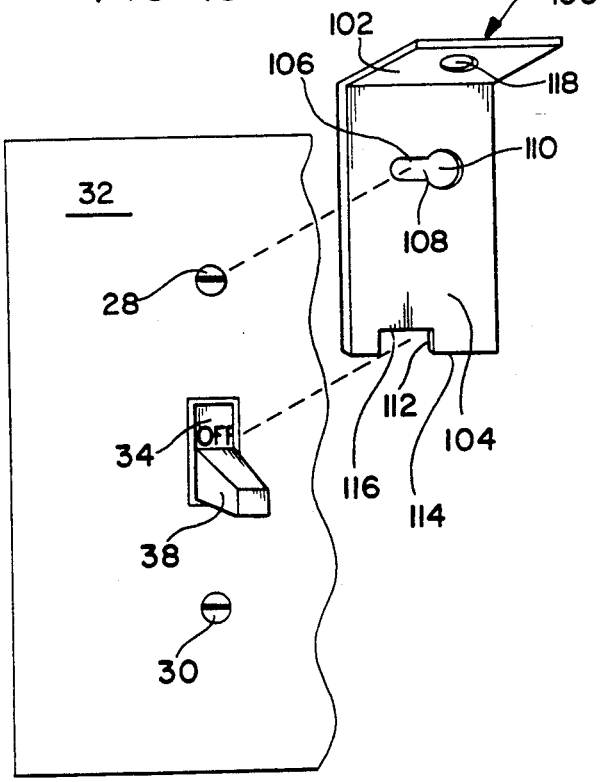
FIG. 15 is an exploded, perspective view of a switch locking mechanism according to a second embodiment of present invention.
Figure 16:
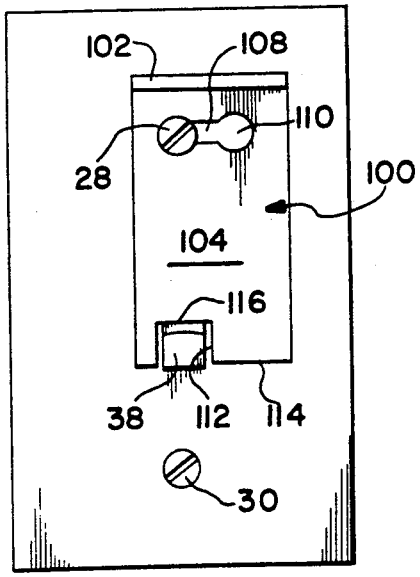
FIG. 16 is a front elevational view of the switch locking mechanism of FIG. 15, fully installed.

According to the second embodiment of the invention illustrated in FIGS. 15 and 16, locking device 100 is in the form of a generally L-shaped bracket having a horizontal planar member 102 and a vertical planar member 104. The members are relative rigid and can be formed of metal or plastic. Vertical member 104 has an opening 106 for receiving mounting screw 28. An access slot 108 with an enlarged end 110 extends laterally from opening 106. Enlarged end 110 has a diameter greater than the diameter of the head of a standard mounting screw 28. Opening 106 and slot 108 have widths larger than the threaded shank of screw 28, but less than the diameter of the head of the screw.

Vertical member 104 also has an opening 112 in the form of a notch extending from and opening on an end edge 114 of member 104 remote from horizontal member 102. Opening 112 has a width slightly larger than the width of toggle arm 38. An abutment 116 defines the upper end of opening 112 and is spaced from opening 106 by a distance sufficient to engage toggle arm 38 and retain it in its off or on position when locking device 100 is mounted on the face plate 32. In the position illustrated in FIG. 16, the switch is retained in its off position. If the locking device is inverted and attached by mounting screw 30, the switch will be maintained in its on position.

Locking device 100 is mounted on the face plate by loosening screw 28, but retaining it at least partially within the face plate. The screw is passed through enlarged end 110 and moved through access slot 108, while toggle arm 38 is located within opening 112. When the screw is fully received within opening 108, the screw is then tighten to lock toggle arm 38 in its down or off position.

At aperture 118 is formed in horizontal member 32 for receiving a warning tag, similar to tag 88, that hangs in front of and obscures both mounting screw 28 and switch toggle arm 38.

Both embodiments of the invention can be adapted to accommodate a row of adjacent switches.

While various embodiments have been chosen to illustrate the invention, it will be understood by those skilled in the art that various changes and modifications can be made therein without the departing from the scope of the invention as defined in the appended claims.

I claim:

1. A locking device for an electrical toggle switch with a toggle arm, comprising:

a fixed, one piece body;

a first opening extending through said body for receiving a first mounting screw for a switch face plate to mount said body on the face plate;

first access means, in said body adjacent to said first opening, for allowing movement of the mounting screw from a position completely outside of and spaced from said first opening to another position in said first opening while the screw is still engaged with the face plate; and a second opening extending through said body and spaced from said first opening, said second opening being defined by abutment means for engaging a toggle arm of a switch and for preventing movement of the toggle arm from a first position to a second position.

2. A locking device according to claim 1 wherein said body comprises a side surface; and said access means comprises a slot extending laterally from said first opening and opening onto said side surface of said body.

3. A locking device according to claim 2 wherein said slot is arcuate.

4. A locking device according to claim 1 wherein a third opening extends through said body for receiving a second mounting screw for the switch face plate to mount said body on the face plate, said third opening being spaced from said first and second openings and being on a side of said second opening opposite said first opening; and second access means is provided in said body adjacent said third opening for allowing movement of the respective mounting from a position completely outside of and spaced from said third opening to another position in said third opening while such screw is still engaged with the face plate.

5. A locking device according to claim 4 wherein said first and second access means comprise first and second slots extending laterally in opposite directions from said first and third openings, respectively, and opening onto opposite side surfaces of said body.

6. A locking device according to claim 5 wherein said slots are arcuate and define arcs on a common circle.

7. A locking device according to claim 4 wherein said body comprises first and second transverse bores, each of said bores extending through said body, opening on opposite sides of said body and extending across one of said first and third openings.

8. A locking device according to claim 7 wherein a blocking member extends through one of said transverse bores and over the respective one of said first and third openings to block access to one of the mounting screws.

9. A locking device according to claim 8 wherein said blocking member comprises a hasp coupled to a lock.

10. A locking device according to claim 7 wherein a flexible member, coupled to a warning tag, extends through one of said transverse bores.

11. A locking device according to claim 1 wherein said body comprises a transverse bore extending through said body, opening on opposite sides of said body and extending across said first opening.

12. A locking device according to claim 11 wherein a blocking member extends through said transverse bore and over said first opening to block access to one mounting screw.

13. A locking device according to claim 1 wherein said body comprises first and second retention means for releasably attaching loose mounting screws.

14. A locking device according to claim 1 wherein the first position is an off position and the second position is an on position.

15. A locking device according to claim 1 wherein said first opening is defined by radially inwardly extending riblets for frictionally engaging and retaining mounting screw in said first opening.

16. A locking device according to claim 1 wherein said body comprises first and second generally planar members oriented substantially at a right angle, said first and second openings being in said first planar member.

17. A locking device according to claim 16 wherein said second opening extends from and opens on an end edge of said first planar member remote from said second planar member.

18. A locking device according to claim 16 wherein said second planar member has an aperture extending therethrough for receiving a warning tag.

19. A locking device according to claim 1 wherein said access means comprises a slot extending laterally from said first opening and terminating in an enlarged portion.

20. An electrical switch, comprising:

a toggle arm extending from a switch body;

a face plate with a center opening through which said toggle arm extends and with front and back surfaces;

first and second maintain screws attaching said switch body to said back surface of said face plate, said screws having heads overlying said front surface;

a fixed, one piece locking body;

a first opening extending through said locking body for receiving said first mounting screw;

first access means, in said locking body adjacent to said first opening, for allowing movement of said first mounting screw from a position completely outside of and spaced from said first opening to another position in said first opening while said first mounting screw is still engaged with said face plate; and a second opening extending through said locking body and spaced from said first opening, said second opening being defined by abutment means engaging said toggle arm and preventing movement said toggle arm from a first position to a second position.

21. A locking device according to claim 20 wherein a third opening extends through said locking body for receiving said second mounting screw, said third opening being spaced from said first and second openings and being on a side of said second opening opposite said first opening; and second access means is provided in said locking body adjacent said third opening for allowing movement of said second mounting screw from a position completely outside of and spaced from said third opening to another position in said third opening while such screw is still engaged with said face plate.

22. A locking device according to claim 21 wherein said first and second access means comprise first and second slots extending laterally in opposite directions from said first and third openings, respectively, and opening onto opposite side surfaces of said locking body.

23. A locking device according to claim 22 wherein said slots are arcuate and define arcs on a common circle.

24. A locking device according to claim 21 wherein said locking body comprises first and second transverse bores, each of said bores extending through said locking body, opening on opposite sides of said locking body and extending across one of said first and third openings.

25. A locking device according to claim 20 wherein said locking body comprises first and second generally planar members oriented substantially at a right angle, said first and second openings being in said first planar member.

26. A locking device according to claim 25 wherein said second opening extends from and opens on an end edge of said first planar member remote from said second planar member.

27. A locking device according to claim 25 wherein said second planar member has an aperture extending therethrough for receiving a warning tag.

* * * * *